US007934601B2

(12) United States Patent
Matsuura et al.

(10) Patent No.: US 7,934,601 B2
(45) Date of Patent: May 3, 2011

(54) BILL DISCRIMINATING AND COUNTING APPARATUS FOR MULTIPLE CURRENCY SYSTEMS

(75) Inventors: Shinji Matsuura, Himeji (JP); Hajime Morino, Himeji (JP)

(73) Assignee: Glory, Ltd., Hyogo (JP)

( * ) Notice: Subject to any disclaimer, the term of this patent is extended or adjusted under 35 U.S.C. 154(b) by 609 days.

(21) Appl. No.: 11/914,967

(22) PCT Filed: May 20, 2005

(86) PCT No.: PCT/JP2005/009710

§ 371 (c)(1),
(2), (4) Date: Nov. 20, 2007

(87) PCT Pub. No.: WO2006/123439

PCT Pub. Date: Nov. 23, 2006

(65) Prior Publication Data

US 2009/0090660 A1 Apr. 9, 2009

(51) Int. Cl.
*B07C 5/00* (2006.01)

(52) U.S. Cl. ..... 209/534; 382/135; 194/206

(58) Field of Classification Search ..... 209/534; 382/135; 235/379; 902/11, 12, 20, 21; 194/205–207

See application file for complete search history.

(56) References Cited

U.S. PATENT DOCUMENTS

| | | | | |
|---|---|---|---|---|
| 6,241,069 | B1 | 6/2001 | Mazur et al. | |
| 6,381,354 | B1 | 4/2002 | Mennie et al. | |
| 6,621,919 | B2 * | 9/2003 | Mennie et al. | 382/135 |
| 2005/0108165 | A1 * | 5/2005 | Jones et al. | 705/43 |

FOREIGN PATENT DOCUMENTS

| | | | |
|---|---|---|---|
| JP | 2000149086 | A | 5/2000 |
| JP | 2003178348 | A | 6/2003 |
| JP | 2003296783 | A | 10/2003 |

OTHER PUBLICATIONS

European Search Report dated Oct. 22, 2009 in corresponding EP Application No. 05 74 3557.

* cited by examiner

*Primary Examiner* — Stefanos Karmis
*Assistant Examiner* — Jeremy Severson
(74) *Attorney, Agent, or Firm* — Sughrue Mion, PLLC

(57) ABSTRACT

The present invention relates to a bill discriminating and counting apparatus having a function of handling bills of a plurality of currency systems with one machine. That is to say, by providing a plurality of START/STOP keys for starting discriminating and counting of the bills, and by assigning the bills of different currency systems to each of them, the bills of a plurality of currency systems may be handled only by operating the START/STOP key corresponding to the currency system, without performing selection and setting of the currency system each time.

9 Claims, 5 Drawing Sheets

(A)

(B)

BILL DISCRIMINATING AND COUNTING APPARATUS FOR MULTIPLE CURRENCY SYSTEMS

TECHNICAL FIELD

The present invention relates to a bill discriminating and counting apparatus for receiving bills by a hopper and discriminating a denomination of received bills and counting the same to calculate a total amount of the received bills or the number of bills for each denomination, and specifically, relates to the bill discriminating and counting apparatus having a function to handle the bills of a plurality of currency systems with one machine.

BACKGROUND ART

The bill discriminating and counting apparatus, which receives the bills of which denominations are mixed in a block by the hopper, feeds the received bills one by one to carry, discriminates the denominations and authenticity thereof and counts the same, and calculates the total amount of the received normal bills or the number of bills for each denomination and displays the same, is conventionally known.

In such a conventional bill discriminating and counting apparatus, much effort for setting and making a choice of a variety of functions before starting to use the machine is required, so that a simplified operation for setting is conventionally desired. Especially, when handling the bills of a plurality of currency systems, a setting operation thereof has been complicated. That is to say, in a case in which the bills of one country are discriminated and counted and after that the bills of another country are discriminated and counted, it has been required to turn the power off once and turn the power on again to perform setting for performing discrimination and counting of the bills of another country. As a background of processing the bills of a plurality of currency systems, in China as a representative case of a member of the Asia area, for example, it is required to process both of yuan, which is the local currency, and U.S. dollar, which is the international currency, and in Britain as a representative case of a member of the Euro area, it is required to process both of pound, which is the local currency, and euro, which is the unified currency.

As the bill discriminating and counting apparatus having a function to handle the bills of a plurality of currency systems with one machine, there is one shown in Japanese Patent Application Laid-Open No. 2000-149086 (patent document 1), for example.

The bill discriminating and counting apparatus shown in the above-mentioned patent document 1 is provided with the nationality setting mode, and is capable of handling the bills of the specific country by turning the power on while pressing the specific key.

For example, by turning the power on while pressing the "DENOMI" key, it becomes possible to handle the bills of the United States, and by turning the power on while pressing the "CLR" key, it becomes possible to handle the bills of France. Meanwhile, although it is disclosed in the above-mentioned patent document 1 that the nationality of the bills to be handled is switched while maintaining the power on, in any event, it is not possible to shift to the bill setting of next country until the processing of the bills of one country is finished, so that it was not possible to perform setting of the bills of a plurality of countries at one time. In addition, it has been required that the counting mode is performed for every switching of nationalities, so that it remained that the setting operation is complicated.

DISCLOSURE OF THE INVENTION

Problems to be Solved by the Invention

The present invention has been made in view of the above-described circumstances, and an object thereof is to provide a bill discriminating and counting apparatus capable of performing settings of bills of a plurality of currency systems at one time, without re-supplying the power.

Means for Solving the Problems

The present invention relates to a bill discriminating and counting apparatus having a function of handling bills of a plurality of currency systems with one machine, and the above-described object of the present invention will be achieved by a bill discriminating and counting apparatus comprising: a hopper for receiving bills to be processed; a feeding/carrying section for feeding the bills received by the hopper one by one to a transport path to carry; a discriminating/counting section disposed on a downstream side of the feeding/carrying section for performing denomination discrimination and counting of the carried bills; and a stacker disposed on a downstream side of the discriminating/counting section for accumulating the bills, which are judged and discriminated to be normal by the discriminating/counting section, wherein bill characteristics information memorizing means in which characteristics information about the bills of a plurality of currency systems is memorized in sets for each currency system; currency system selection/setting means for assigning the currency system of the bills to be processed to any of a plurality of specific keys when this is selected; and control means for feeding and carrying the bills in response to pressing of the any of specific keys, comparing the bills with the characteristics information of the bills corresponding to the current system, which is assigned to the specific key, and performing discrimination and counting of the bills, are provided, and wherein a memory area for memorizing the discriminating/counting result is provided for each of the currency systems.

Also, the above-described object of the present invention will be effectively achieved by further comprising counting mode setting means.

Further, the above-described object of the present invention will be more effectively achieved by further comprising a displaying section and displaying a currency unit of the currency system, which is assigned to the specific key, on the displaying section in accordance with pressing of the specific key, or by setting the specific key to a START/STOP key and setting the number thereof two, and assigning euro, which is the currency unit, to one of them, or by comprising an occupancy status displaying means for displaying which of the START/STOP keys is occupied now, or by making the occupancy status displaying means LED lamp.

BEST MODE FOR CARRYING OUT THE INVENTION

The present invention relates to a bill discriminating and counting apparatus having a function to handle bills of a plurality of currency systems with one machine. That is to say, by providing a plurality of START/STOP keys for starting discriminating and counting the bills and by assigning the bills of different currency systems to each of them, it becomes possible to handle the bills of a plurality of currency systems only by operating the START/STOP key corresponding to the currency system, without performing selection and setting of the currency system each time.

Hereinafter, it will be described in detail with reference to the drawings.

Figure 1:
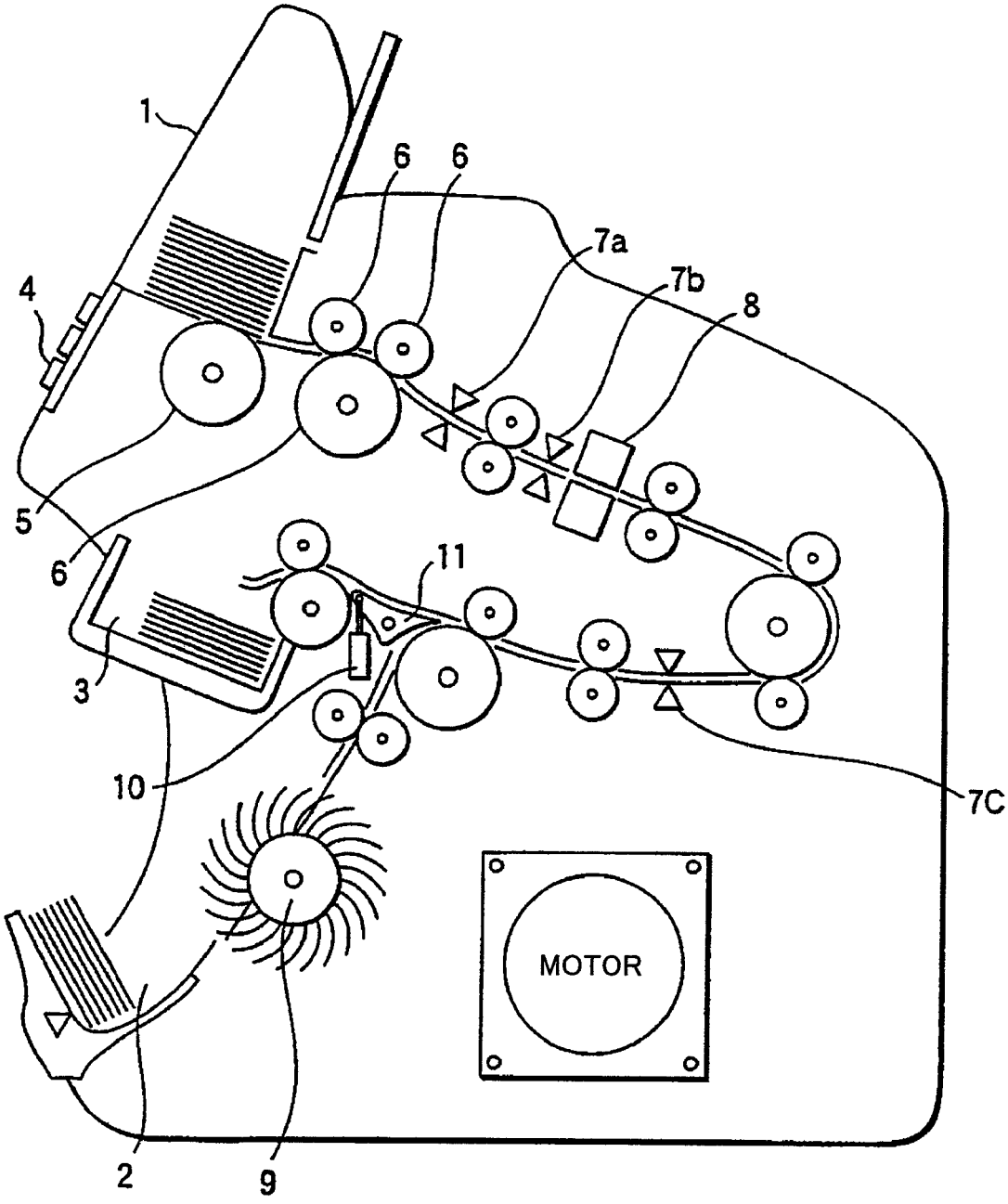
FIG. 1 is a view showing one example of an inner structure of a bill discriminating and counting apparatus according to the present invention.

FIG. 1 is a vertical sectional view showing one example of an inner structure of the bill discriminating and counting apparatus according to the present invention.

The bills put on a hopper 1 are sent to a transport path of the bill discriminating and counting apparatus by a feed roller 5, and are carried by a plurality of carrying rollers 6. In the process of carrying the bills, the bills pass through detecting sensors 7*a* and 7*b*, and denomination discriminating (including authentication judgment) and counting are performed at a discriminating/counting section 8. After that, the bills pass through a detecting sensor 7*c*, and in a case of a normal bill, this is received between blades of a rotating impeller 9, and aligned and collected in a stacker 2. On the other hand, in a case of being judged to be a counterfeit bill at the discriminating/counting section 8, a solenoid 10 is activated and a branching craw 11 moves downward, and the bill is sent to a reject unit 3. Meanwhile, a reference numeral 4 indicates a display/operating section for performing setting of the currency system, setting of a counting mode, and the like, when performing the bill discriminating/counting process. In addition, other than above, a main control section (not shown) for controlling each of the processes according to a predetermined control program and memorizing means (not shown) for memorizing a discriminating/counting result and a variety of set contents are provided.

Figure 2:
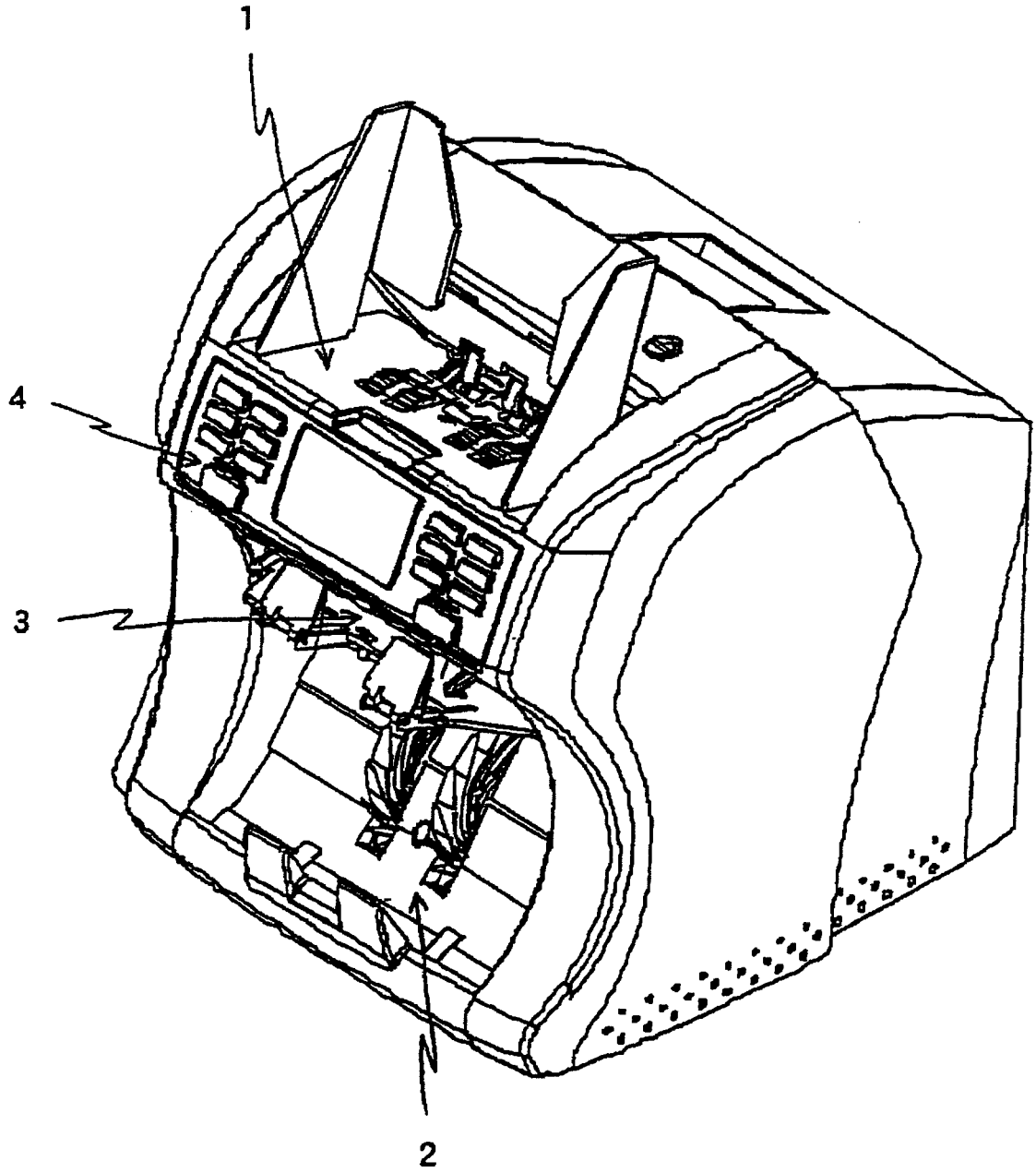
FIG. 2 is a perspective view showing an external view of the bill discriminating and counting apparatus according to the invention of the present application.

FIG. 2 is a perspective view showing an external view of the bill discriminating and counting apparatus according to the invention of the present application. The bills put from the hopper 1 are discriminated and counted within the machine, and aligned and collected in the stacker 2. Also, it is configured that the counterfeit bills and the bills of which transaction is rejected due to damage thereof are sent to the reject section 3. The display/operating section 4 has a variety of operating keys, and setting of the bills of a plurality of currency systems may be performed at one time by a key operation, without re-supplying the power.

Figure 3:
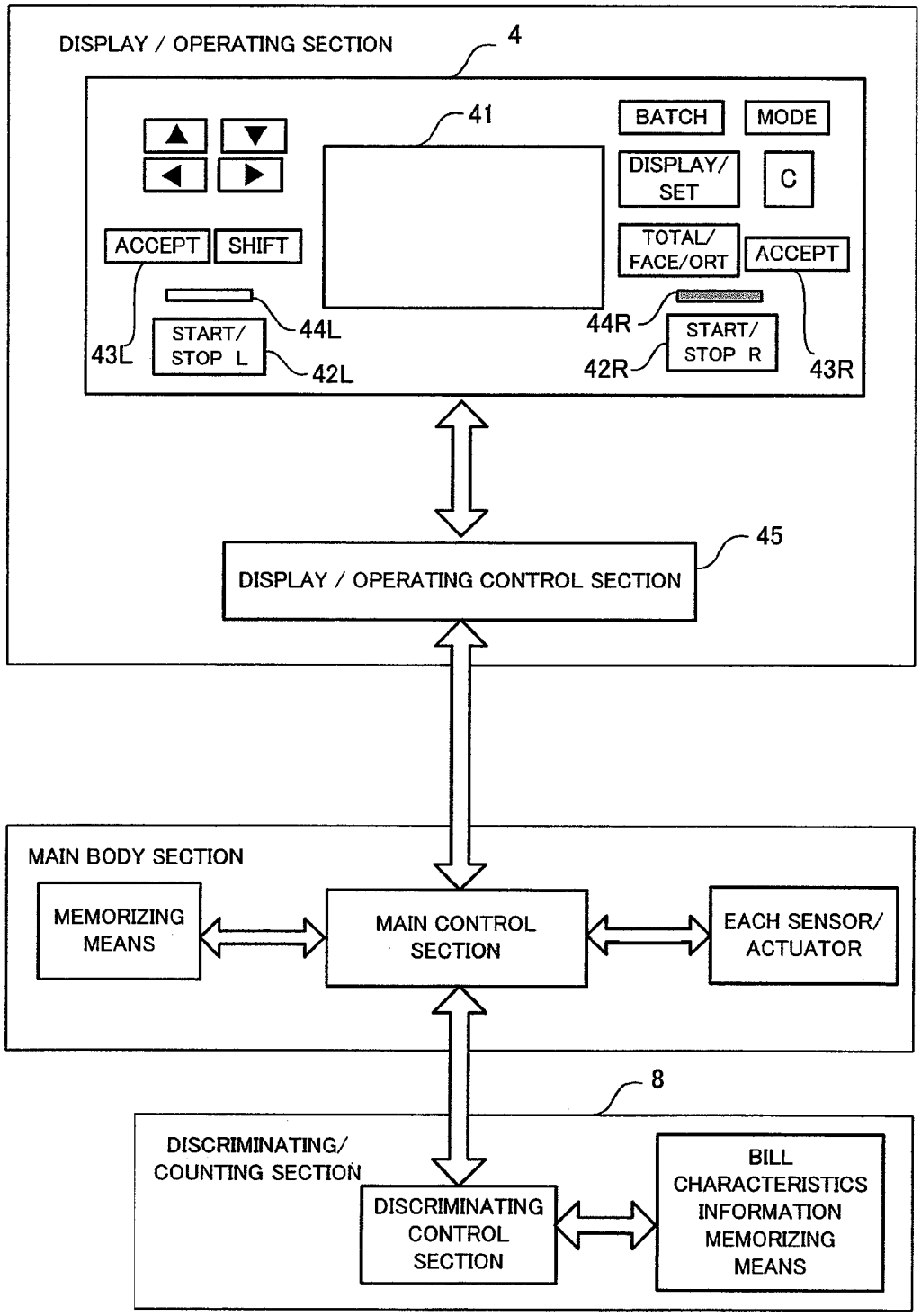
FIG. 3 is a control block diagram of the bill discriminating and counting apparatus according to the present invention.

FIG. 3 is a control block diagram of the bill discriminating and counting apparatus according to the present invention. A liquid crystal panel 41 for performing various sorts of displays is arranged on a central portion of the display/operating section 4, and a pair of START/STOP keys 42, a pair of ACCEPT keys 43, and a pair of occupancy displaying LEDs 44 are arranged separately on right and left sides thereof, respectively. In addition, a DISPLAY/SET key is for switching to a user setting mode by pressing the same together with a SHIFT key, and a MODE key is for performing setting of a counting mode (MIX mode (mixed denomination deposit) and DD mode (single denomination deposit), for example). For example, it is possible to configure such that the counting mode is switched each time the MODE key is pressed. A display/operation control section 45 is operable to control displaying the discriminating/counting result and the set contents on the liquid crystal panel 41, and to control transmitting a control signal, which is generated by an operation of each key, to a main control unit to be described later, and, a one-chip microcomputer or the like may be utilized, for example. Meanwhile, the occupancy displaying LEDs 44L and 44R are for indicating which of the START/STOP keys is occupied now, by a lighting.

A main body section is provided with a main control section for controlling an operation of each sensor and each actuator (indicating a feeding/carrying section, the solenoid, and the like) of the bill discriminating and counting apparatus and for controlling writing to and reading from memorizing means for memorizing contents set at the display/operating section, the discriminating/counting result, and the like. Meanwhile, a nonvolatile memory is used as the memorizing means, and the one-chip microcomputer or the like may be used, for example, as the main control section.

In addition, the discriminating/counting section 8 is provided with bill characteristics information memorizing means storing characteristics information (image data, for example) of the bills of the currency systems of several countries, and a discrimination control section for performing discrimination of the bills by comparing the image data of the bill to be tested, which is read by the sensor, and the bill characteristics information. Meanwhile, the information of the currency system (nationality) of the bill to be tested is transmitted from the main control section to the discrimination control section, so that the discrimination control section may read only the characteristics information of the bill of that country as data of a target to be compared, thereby shortening a time for matching process. The one-chip microcomputer or the like may be used, for example, as the discrimination control section.

Figure 4:
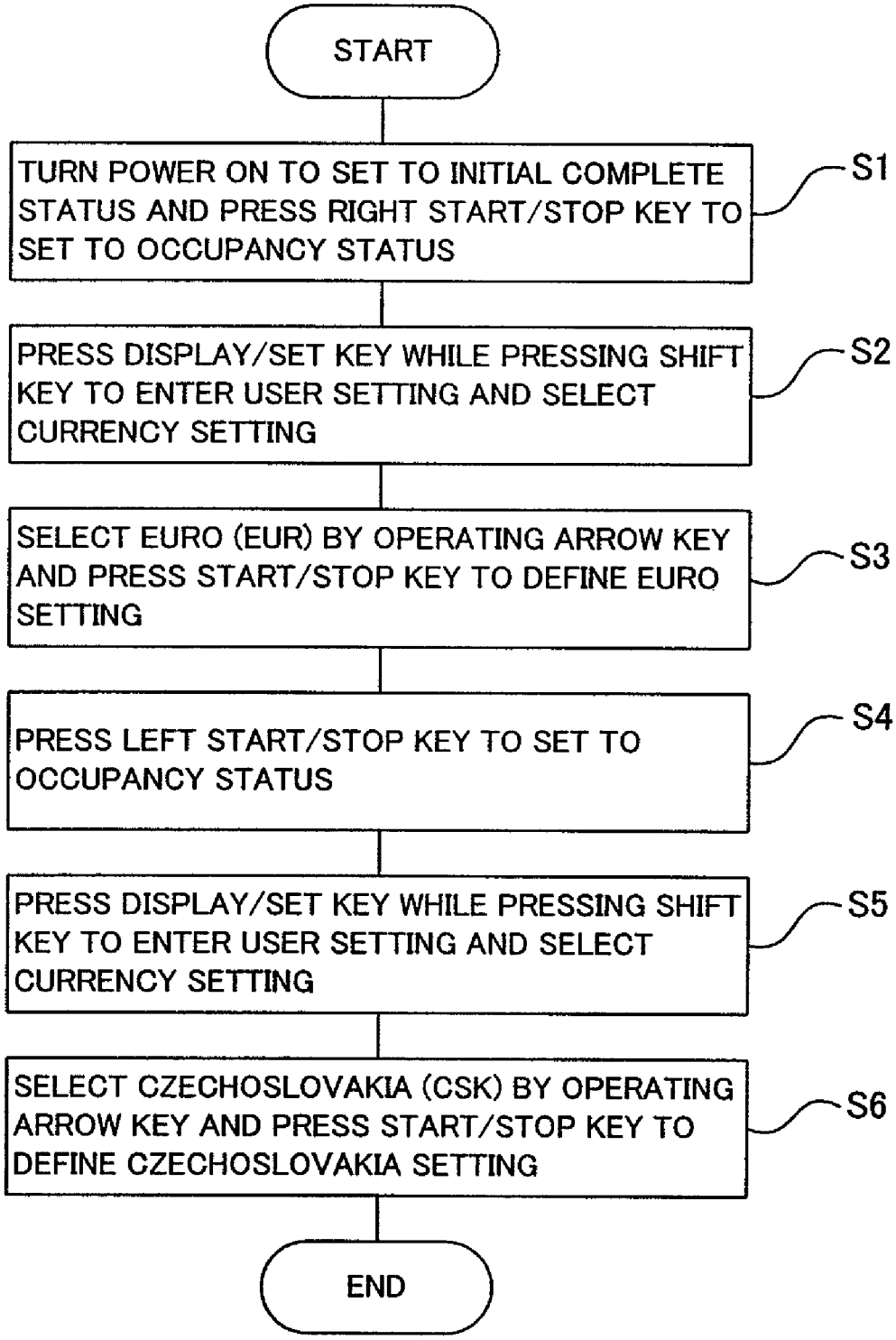
FIG. 4 is a flow chart of a case in which different currency systems are assigned to each of two START/STOP keys.

FIG. 4 is a flow chart of a case in which different currency systems are assigned to right and left two START/STOP keys, respectively. It will be described with reference to this drawing.

Figure 5:
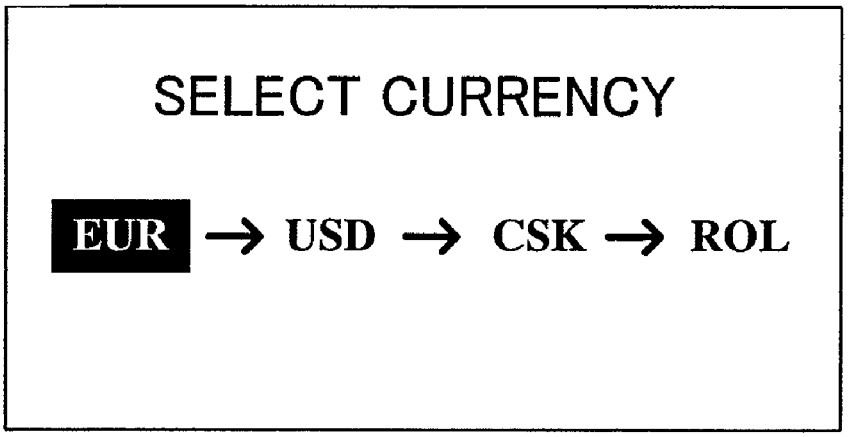
FIG. 5 is a view showing one example of currency system selection screen of the bills.
Figure 5:
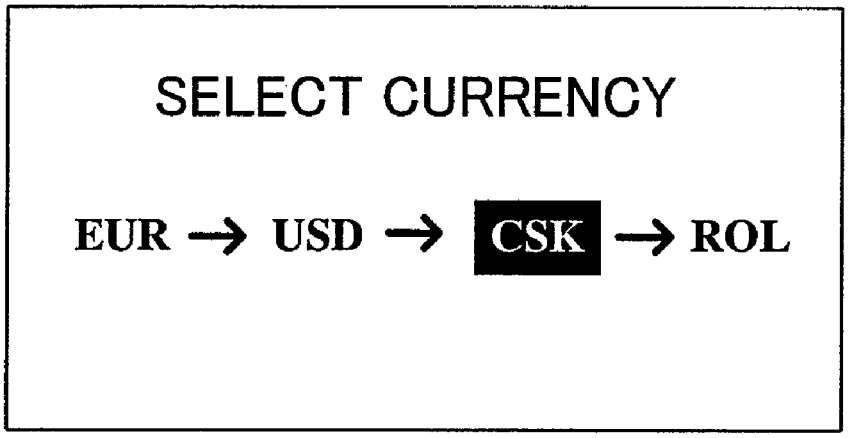

The power is turned on and it is set to an initial complete status, then an operator presses a right START/STOP key 42R to set to an occupancy status (step S1). Next, the operator presses the DISPLAY/SET key while pressing the SHIFT key to shift to the user setting mode, and selects the currency setting (step S2). Herein, it is displayed as in FIG. 5(A) on the liquid crystal panel 41 of the display and this indicates that Euro (EUR) is selected. Herein, by pressing the START/STOP key 42R, Euro setting to the right START/STOP key 42R is defined (step S3).

Next, the operator presses a left START/STOP key 42L and it is set to the occupancy status (step S4). Then, the operator presses the DISPLAY/SET key while pressing the SHIFT key to shift to the user setting mode, and selects the currency setting (step S5). Herein, it is displayed as in FIG. 5(A) on the liquid crystal panel 41 of the display, so that the operator selects Czechoslovakia (CSK) as in FIG. 5(B) by using an arrow key. Herein, by pressing the START/STOP key 42L, Czechoslovakia setting to the left START/STOP key 42L is defined (step S6). In this manner, the currency systems of the different bills are assigned to each of the right and left START/STOP keys. Meanwhile, it is possible to change the counting mode independently from the setting of the assignment of the currency systems, and when the power is turned off, most recently used counting mode is memorized.

Procedure in a case of performing discrimination and counting of the bills of Czechoslovakia and Euro with the bill discriminating and counting apparatus in which the settings of the bills of Czechoslovakia and Euro are assigned to the right and left START/STOP keys 42R and 42L, respectively, as above will be described.

First, the operator puts the euro bills on the hopper 1 and presses the right START/STOP key 42R. The bills are fed and carried, discrimination and counting are performed at the discriminating/counting section 8, and in a case of normal bill, this is carried to the stacker 2, and in a case of abnormal bill, this is carried to the reject unit 3. When the bill disappears from the hopper 1, feeding and carrying are stopped and the counting result is displayed on the liquid crystal panel 41 of the display/operating unit. Herein, by pressing a right ACCEPT key 43R, deposit is settled and the counting result of the euro bills is memorized in a memory area, which is assigned to the START/STOP key 42R, in the memorizing means.

Next, the operator puts the Czechoslovakia bills on the hopper 1 while leaving the power of the bill discriminating and counting apparatus on, and presses the left START/STOP key 42L. The bills are fed and carried, discrimination and counting are performed at the discriminating/counting section 8, and in a case of normal bill, this is carried to the stacker 2, and in a case of abnormal bill, this is carried to the reject unit 3. When the bill disappears from the hopper 1, feeding and carrying are stopped and the counting result is displayed on the liquid crystal panel 41 of the display/operating section. Herein, by pressing a left ACCEPT key 43L, deposit is settled and the counting result of the Czechoslovakia bills is memorized in the memory area, which is assigned to the START/STOP key 42L, in the memorizing means.

Although the present invention has been described based on the examples, as above, the technical features of the present invention are as recited in Claims, and are not limited to this examples, and various kinds of variations may be possible.

INDUSTRIAL APPLICABILITY

According to a bill discriminating and counting apparatus according to the present invention, it is possible to perform setting of bills of a plurality of currency systems at one time, without re-supplying the power, so that operating efficiency will be improved when processing the bills of a plurality of currency systems.

Also, since the currency system of the bills to be processed is set in a START/STOP key in advance, it becomes possible to use comparison data (bill characteristics information) for discriminating of only the set currency system, so that a time for matching process may be shortened.

The invention claimed is:

1. A bill discriminating and counting apparatus comprising:

a hopper for receiving bills to be processed;

a feeding/carrying section for feeding the bills received by the hopper one by one to a transport path to carry;

a discriminating/counting section disposed on a downstream side of the feeding/carrying section for performing denomination discrimination and counting of the carried bills;

a stacker disposed on a downstream side of the discriminating/counting section for accumulating the bills, which are judged and discriminated to be normal by the discriminating/counting section;

bill characteristics information memorizing means in which characteristics information about the bills of a plurality of currency systems is memorized in sets for each currency system;

a plurality of specific keys for feeding and carrying the bills;

currency system selection/setting means for assigning the currency system of the bills to be processed to any of the specific keys when the currency system is selected; and control means for feeding and carrying the bills in response to pressing of the any of specific keys, comparing the bills with the characteristics information of the bills corresponding to the currency system, which is assigned to the specific key, and performing the discrimination and the counting of the bills.

2. The bill discriminating and counting apparatus according to claim 1, further comprising counting mode setting means.

3. The bill discriminating and counting apparatus according to claim 1, further comprising a displaying section for displaying a currency unit of the currency system, which is assigned to the specific key, on the displaying section, with pressing of the specific key.

4. The bill discriminating and counting apparatus according to claim 3, wherein the specific key is a START/STOP key and the number of the keys are two, and euro, which is a currency unit, is assigned to one of the keys.

5. The bill discriminating and counting apparatus according to claim 4, comprising occupancy status displaying means for displaying which of the START/STOP keys is occupied.

6. The bill discriminating and counting apparatus according to claim 5, wherein the occupancy status displaying means is an LED lamp.

7. The bill discriminating and counting apparatus according to claim 1, wherein the specific key is a START/STOP key and the number of the keys are two, and euro, which is a currency unit, is assigned to one of the keys.

8. The bill discriminating and counting apparatus according to claim 7, comprising occupancy status displaying means for displaying which of the START/STOP keys is occupied.

9. The bill discriminating and counting apparatus according to claim 8, wherein the occupancy status displaying means is an LED lamp.

* * * * *